United States Patent [19]

Nestor

[11] Patent Number: 4,768,970

[45] Date of Patent: Sep. 6, 1988

[54] ELECTRICAL CONNECTOR PLUG ASSEMBLY FOR SEALED ELECTRICAL CONNECTION

[75] Inventor: Charles R. Nestor, Niles, Ohio

[73] Assignee: General Motors Corporation, Detroit, Mich.

[21] Appl. No.: 117,046

[22] Filed: Nov. 5, 1987

[51] Int. Cl.[4] ..... H01R 13/52

[52] U.S. Cl. ..... 439/278; 439/589; 439/281

[58] Field of Search ..... 439/278, 279, 281–283, 439/587–589

[56] References Cited

U.S. PATENT DOCUMENTS 3,851,296 11/1974 Muchmore et al. ..... 439/589

3,994,553 11/1976 Kornick ..... 439/281

*Primary Examiner*—Gil Weidenfeld

*Assistant Examiner*—P. Austin

*Attorney, Agent, or Firm*—F. J. Fodale

[57] ABSTRACT

A sealed electrical connection comprises a socket connector and an electrical connector plug assembly. The electrical connector plug assembly comprises a combined holder-latch member for a plurality of subassemblies which include elastomeric seals fitted onto insulator housings forming part of ignition cable termination assemblies.

8 Claims, 3 Drawing Sheets

ELECTRICAL CONNECTOR PLUG ASSEMBLY FOR SEALED ELECTRICAL CONNECTION

BACKGROUND OF THE INVENTION

This invention relates to an electrical connector plug assembly and more particularly to an electrical connector plug assembly for ignition cable which provides a sealed electrical connection to a socket connector of an ignition coil or the like.

In the past ignition cables have been connected to ignition coils by forming a connector plug at the end of the ignition cable. This connector plug commonly comprised a sheet metal terminal attached to the end of the ignition cable and a seal boot or nipple mounted on the end of the ignition cable to form a chamber for the sheet metal terminal. The sheet metal terminal plugged into a socket connector of the ignition coil housing and the seal boot sealed against the ignition coil housing in some fashion to provide a sealed connection to the ignition coil.

SUMMARY OF THE INVENTION

In one aspect, the object of this invention is to provide an electrical connector plug assembly which is attached to the end of an ignition cable or cables and which has an improved sealing arrangement for providing a sealed electrical connection when the electrical connector plug assembly is plugged into a socket connector of an ignition coil housing or the like.

A feature of the improved sealing arrangement of the invention is that the electrical connector plug assembly of the invention has a one piece elastomeric seal which provides both an interface seal with the socket connector of the ignition coil housing into which the electrical connector plug assembly is plugged and a conductor seal with the ignition cable on which the electrical connector plug assembly is attached.

Another feature of the improved sealing arrangement of the invention is that the elastomeric seal has several radial sealing lips in a stepped diameter arrangement to provide multiple seals while reducing connector engagement force requirements.

Still yet another feature of the improved sealing arrangement of the invention is that the elastomeric seal includes an axial sealing lip for sealing against the face of socket connector of the ignition coil housing.

Still yet another feature of the improved sealing arrangement is that the elastomeric seal fits over an insulator housing for the ignition cable terminal while providing both an interface seal with the socket connector of the ignition coil housing into which the electrical connector plug assembly is plugged and a conductor seal with the ignition cable on which the electrical connector plug assembly is attached.

Yet still another feature of the improved sealing arrangement is that the elastomeric seal which fits over the insulator housing for the ignition cable terminal has provisions for mounting the elastomeric seal and insulator housing in a holder which facilitates connection to a mating socket connector.

In another aspect, the object of this invention is to provide an electrical connector plug assembly, which has an elastomeric seal which has an interface seal at one end and a cable seal at the other end, with a relatively stiff latch member which is carried by the elastomeric seal for latching the electrical plug connector to the socket connector of the ignition coil housing.

A feature of this aspect of the invention is that latch member is mounted on the elastomeric seal so as to enhance the sealing characteristics of the elastomeric sealing member when the electrical connector plug assembly is plugged into the socket connector of the ignition coil housing and latched.

Another feature of this aspect of the invention is that the latch member is part of a holder which facilitates connection to a mating socket connector particularly when a plurality of ignition cables is involved.

Still yet another feature of this aspect of the invention is that the combined holder-latch member includes guide means for guiding the electrical connector plug assembly into proper engagement with the socket connector of the ignition coil housing or the like.

Other objects and features of the invention will become apparent to those skilled in the art as disclosure is made in the following detailed description of a preferred embodiment of the invention which sets forth the best mode of the invention contemplated by the inventors and which is illustrated in the accompanying sheet(s) of drawing.

DETAILED DESCRIPTION OF THE PREFERRED EMBODIMENT

Figure 1:
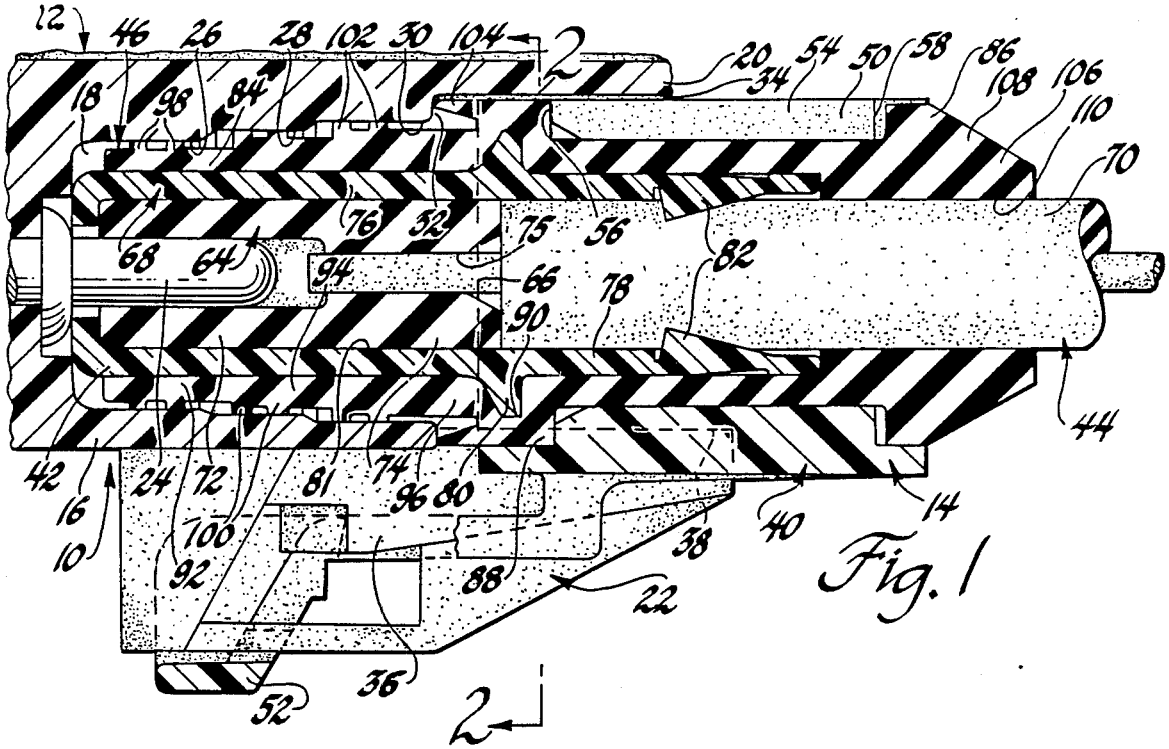
FIG. 1 is a longitudinal sectional view of a sealed electrical connection comprising a socket connector of an ignition coil housing or the like, and an electrical connector plug assembly in accordance with this invention.

Referring now to the drawings and more particularly to FIGS. 1–5 the sealed electrical connection, which is indicated generally at 10 comprises a socket connector 12 and an electrical connector plug assembly 14.

Figure 5:
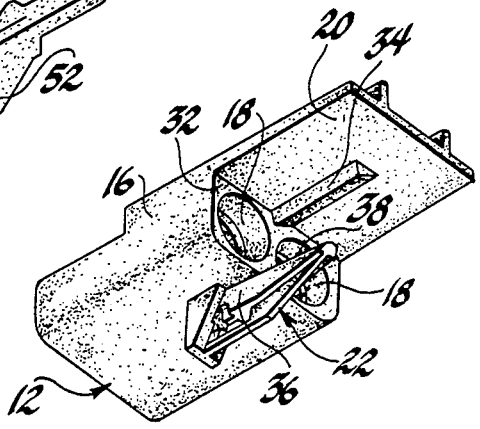
FIG. 5 is a perspective view of the socket connector which is shown in FIGS. 1 and 2.

The socket connector 12, which may be part of a housing for an ignition coil or the like (not shown), comprises a connector body portion 16 having two laterally spaced cavities 18, an upper planar shelf 20 which projects forwardly of the connector body portion 16 in the longitudinal or axial direction of the cavities 18 and a depending latch member 22 which also projects forwardly of the connector body portion 16 as best shown in FIG. 5.

As seen in FIG. 1, a pin terminal 24 is centrally located in each of the laterally spaced cavities 18 and projects from the closed end of each cavity. Each of the laterally spaced cavities 18 as a stepped peripheral wall which provides three circumferential sealing surfaces 26, 28 and 30 which progressively increase in diameter toward the open end of the cavity at the end face 32.

The upper planar shelf 20 has a depending, longitudinal, wedge-shaped guide rib 34. The latch. member 22 includes a latch nib 36 below the body portion 16 and a rounded guide rib 38 on the projecting portion which is aligned with the guide rib 34 of the shelf 20.

The Electrical Connector Plug Assembly

The electrical connector plug assembly 14 comprises a combined holder-latch member 40; two ignition cable termination assemblies which are attached to the ends of ignition cables or the like, such as the ignition cable termination assembly 42 which is attached to the end of the ignition cable 44; and two elastomeric seals such as the elastomeric seal 46.

The combined holder-latch member 40 comprises two retainer sleeves 48, 50 arranged side-by-side and a deflectable latch arm 52. Each retainer sleeve has a longitudinal assembly slot 54 which extends for the entire length of the retainer sleeve, a forward shoulder 56 and a rearward shoulder 58. The width of the longitudinal assembly slot 54 is large enough so that a sub-assembly comprising an ignition cable termination assembly 42 and elastomeric seal 46 may be inserted into the associated retainer sleeve 48 or 50 as explained below. The shoulders 56 and 58 retain the sub-assembly comprising the ignition cable termination assembly 42 and the elastomeric seal 46 in the retainer sleeve. The combined holder-latch member 40 further comprises aligned upper and lower longitudinal guide grooves 60 and 62 at the juncture of the retainer sleeves 48 and 50. The upper guide groove 60 is V-shaped to match the wedge shaped guide rib 34 of the socket connector 12 and the lower guide groove 62 is rounded to match the rounded guide rib 38.

The Ignition Cable Termination Assembly

Figure 2:
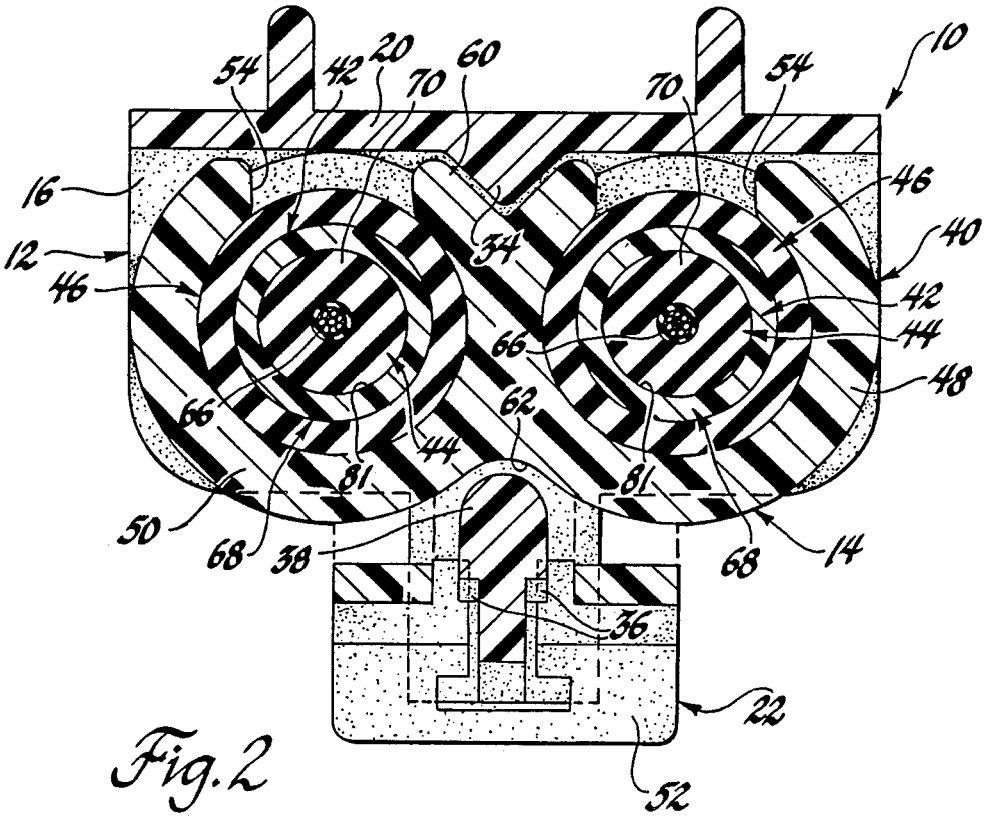
FIG. 2 is a lateral sectional view of the sealed electrical connection taken along the line 2—2 of FIG. 1 looking in the direction of the arrows.

The typical ignition cable termination assembly 42, comprises a terminal 64 which is attached to the bared end of the conductive core 66 at the insulation stripped end of the ignition cable 44 and an insulator housing 68 for the terminal 64 which is secured to the insulation jacket 70 of the ignition cable 44 adjacent the bared end as best shown in FIGS. 1 and 2.

The terminal 64 comprises a conductive elastomeric sleeve which has a socket portion 72 at one end for receiving the mating pin terminal 24 and a ferrule portion 74 at the other end for receiving the bared protruding conductive core 66 at the stripped end of the ignition cable 44. The ferrule portion 74 has a larger outer diameter than the socket portion 74 so that the bared, protruding conductive core 66 of the ignition cable 44 which is disposed in the ferrule portion 74 is resiliently clamped by the ferrule portion 74 when the terminal 64 is inserted into the insulator housing 68.

Figure 6:
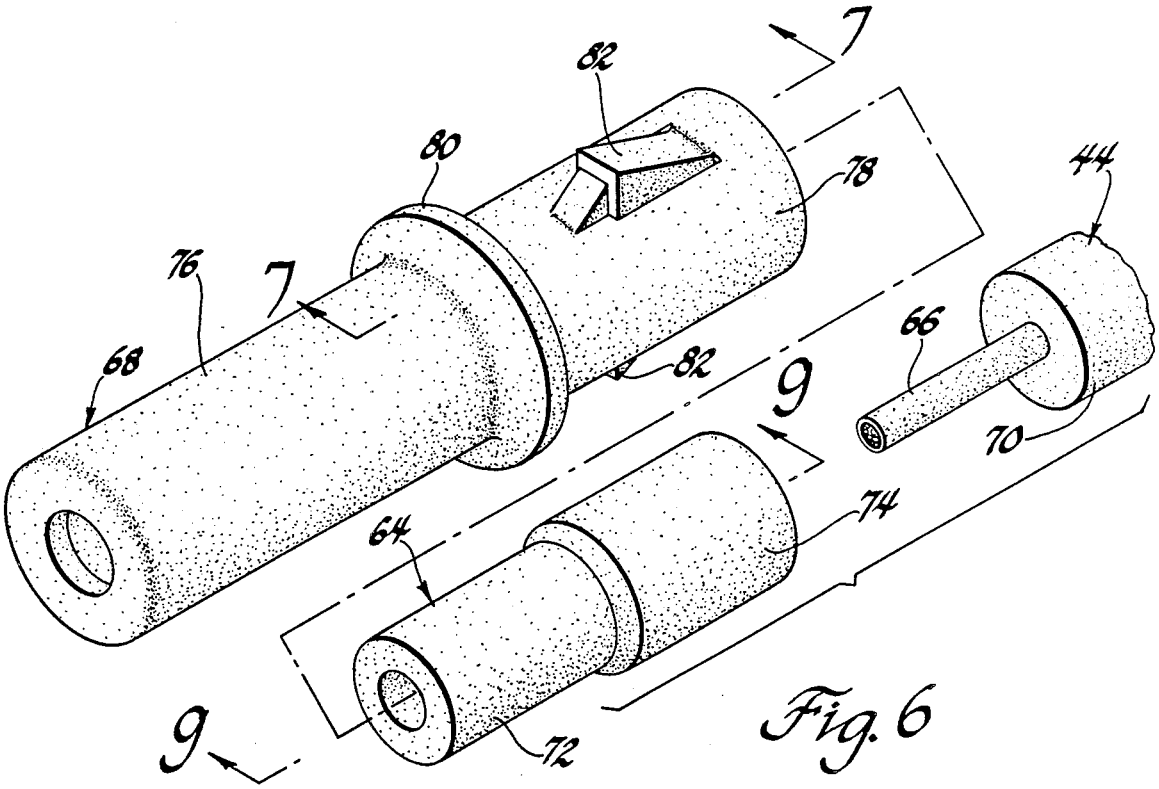
FIG. 6 is an exploded perspective view of an ignition cable termination assembly which is used in the electrical connector plug assembly which is shown in FIGS. 1, 2, 3 and 4.
Figure 7:
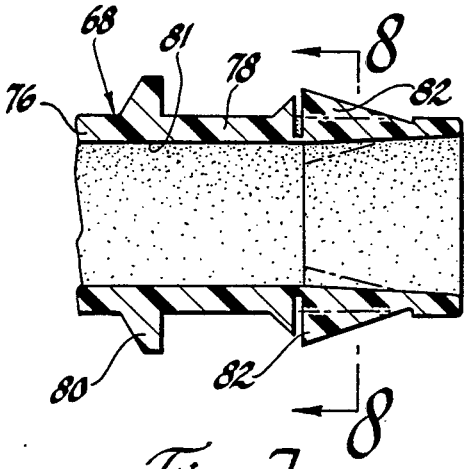
FIG. 7 is a sectional view of an insulator housing of the ignition cable termination assembly which is taken substantially along the line 7—7 of FIG. 6 looking in the direction of the arrows.
Figure 8:
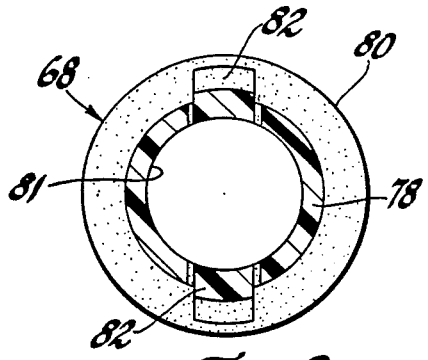
FIG. 8 is a sectional view of the insulator housing taken substantially along the line 8—8 of FIG. 7 looking in the direction of the arrows.
Figure 9:
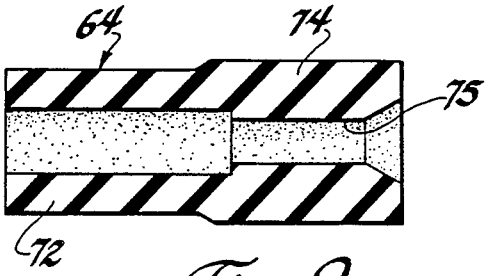
FIG. 9 is a sectional view of a terminal of the ignition cable termination assembly which is taken substantially along the line 9—9 of FIG. 6 looking in the direction of the arrows.

The insulator housing 68 comprises a thermoplastic sleeve which has a plug portion 76 at one end, an attachment portion 78 at the other end and a medial flange 80 which is midway between the ends of the thermoplastic sleeve. The attachment portion 78 has a pair of diametrically opposed integral lock tabs 82 which secure the insulator housing 68 to the insulation jacket 70 of the ignition cable 44 as best shown in FIG. 1. The lock tabs 82 are deformed from an external position shown in FIGS. 6, 7 and 8 to the internally projecting position shown in FIG. 1 where the deformed lock tabs 82 embed in the insulation jacket 70. The lock tabs 82 are preferably deformed by ultrasonic welding techniques.

The ignition cable termination assembly described above and an alternative ignition cable termination assembly are further described in U.S. patent application Ser. No. 117,050 filed by Charles R. Nestor and John A. Yurtin concurrently with this patent application Nov. 5, 1987 and which is hereby incorporated in this patent application by reference.

The Elastomeric Seal

The elastomeric seal 46 comprises an elastomeric sleeve which has a connector seal portion 84 at one end, an attachment portion 86 at the other end and a medial flange 88 which has an internal groove 90 which receives the medial flange 80 of the insulator housing 68 when the insulator housing 68 is disposed inside the elastomeric seal 46 as shown in FIG. 1.

The connector seal portion 84 of the elastomeric seal 46 comprises three stepped sections 92, 94 and 96 which progressively increase in thickness and outer diameter toward the medial flange 88. The stepped sections have respective pairs of radial lip seals 98, 100 and 102 which also progressively increase in outer diameter. The pairs of lip seals 98, 100 and 102 are matched to the sealing surfaces 26, 28 and 30 of the socket connector 12 so that lip seals 98, 100 and 102 sealingly engage the peripheral wall of the cavity at their respective cooperating sealing surfaces 26, 28 and 30 at the same time. In other words, the pair of lip seals 98 do not engage the sealing surfaces 28 and 30 with any significant force as they pass these surfaces on the way to sealingly engage the sealing surface 26. Similarly, the pair of sealing lips 100 do not engage the sealing surface 30 with any significant force as they pass by on the way to sealing surface 28. This matching the of stepped pairs of sealing lips 98, 100 and 102 to the respective stepped sealing surfaces 26, 28 and 30 reduces the force necessary to connect the electrical connector plug assembly 14 to the socket connector 12 to provide the sealed electrical connection 10.

The medial flange 88 of the elastomeric seal 46 also has a longitudinal lip seal 104 which projects toward the connector seal portion 84 and which sealingly engages the end face 32 of the socket connector 12.

The attachment portion 86 of the elastomeric seal 46 has an end flange 106 which has a conical or beveled face 108 at the free end of the attachment portion 86 to facilitate assembly of the elastomeric seal 46 into one of the retainer sleeves of the combined holder-latch member 40. The bore at the free end of the attachment portion 86 has a reduced diameter to provide an internal seal portion 110 for sealing around the insulation jacket 70 of the ignition cable 44.

Assembly of the The Electrical Connector Plug Assembly

The electrical connector plug assembly 14 is assembled in the following manner. Ignition termination assemblies, such as the ignition termination assembly 42, are first attached to the ends of ignition cables such as the ignition cable 44.

Figure 3:
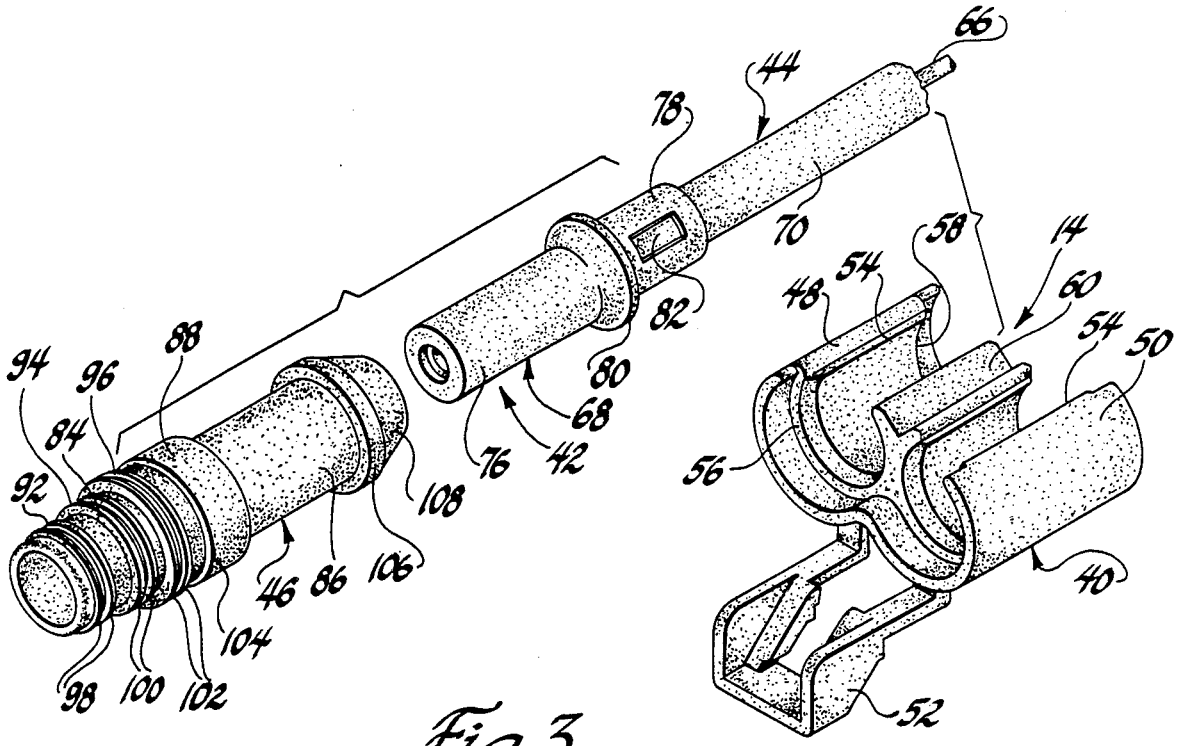
FIG. 3 is an exploded perspective view of the electrical connector plug assembly in accordance with this invention which is shown in FIGS. 1 and 2.
Figure 4:
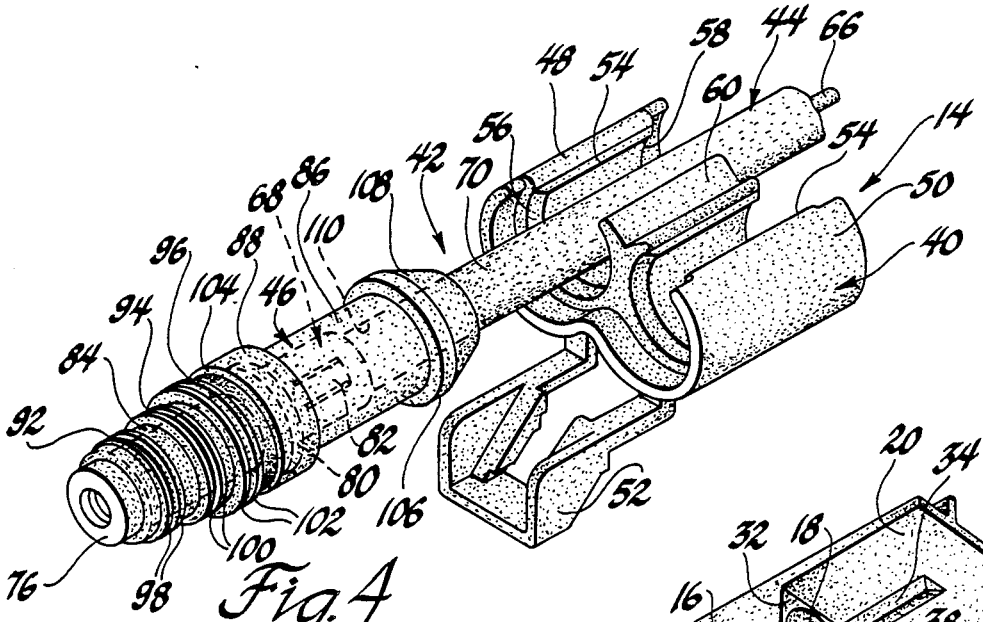
FIG. 4 is a perspective view of a partially assembled electrical connector plug assembly in accordance with this invention.

Each ignition cable termination assembly 42 is then assembled into an elastomeric seal 46 to form a sub-assembly comprising an elastomeric seal 46 fitted onto an termination assembly 42 as shown in FIGS. 3 and 4. During this assembly step, the contact portion 76 of the insulator housing 68 of the ignition cable termination assembly 42 is inserted through the reduced diameter bore forming the internal seal portion 110 of the elastomeric seal 46 until the medial flange 80 of the insulator housing 68 lodges in an internal radial groove 90 in the medial flange 88 of the elastomeric seal 46 whereupon the ignition cable termination assembly 42 is retained in the elastomeric seal 46 and the internal seal portion 110 engages the insulation jacket 70 of the ignition cable 44 behind the insulator housing 68 as shown in FIGS. 1 and 4.

Each sub-assembly comprising an elastomeric seal 46 fitted onto a termination assembly 42 is then assembled to the electrical plug connector assembly 14 by laterally inserting the ignition cable 44 into one of retainer sleeves 48, 50 through the longitudinal assembly slot 54 as shown in FIG. 4. Each sub-assembly is then pulled-to-seat, end flange 106 first, into its respective retainer sleeve 48 or 50 to the position shown in FIGS. 1 and 2. During this assembly step, the beveled face 108 engages the forward shoulder 56 of the retainer sleeve to facilitate the radial compression of the end flange 106 so that it can pass through the retainer sleeve to a retained position past the rearward shoulder 58 where it expands to retain the sub-assembly in the forward direction in cooperation with the rearward shoulder 58. In this retained position, the medial flange 88 of the elastomeric seal 46 retains the sub-assembly in the rearward direction. The rearward retention (which resists the connector attachment forces) is extremely reliable due to the presence of the medial flange 80 of the insulator housing 68 which has an outer diameter which is slightly greater than the inner diameter of the retainer sleeve 48 as shown in FIG. 1.

Alternatively, the assembly slot 54 may be widened so that the sub-assembly comprising the elastomeric seal 46 fitted over the ignition cable termination assembly 42 can be snapped through the assembly slot 54 in a lateral direction directly into its retained position in its respective retainer sleeve 48 or 50.

The electrical connector plug assembly 14, comprising the combined holder-latch member 40, ignition cable termination assemblies 42 and elastomeric seals 46, is plugged into the socket connector 12 with the guide grooves 60 and 62 engaging guide ribs 34 and 38 to guide the connector seal portions 84 of the elastomeric seals 46 and the ignition cable termination assemblies 42 into the cavities 18 of the socket connector 12 so that the sealed electrical connection shown in FIG. 1 is properly made. The electrical plug assembly 14 is latched to the socket assembly 12 by the deflectable latch arm 52 of the combined holder-latch member 40 which rides over and engages behind the lock nib 36 of the depending latch member 22. The latching enhances the sealed connection by biasing the longitudinal lip seal 104 into engagement with the end face 32 of the socket connector 12.

I wish it to be understood that I do not desire to be limited to the exact details of construction shown and described, for obvious modifications will occur to a person skilled in the art.

The embodiments of the invention in which an exclusive property or privilege is claimed are defined as follows:

1. An electrical connector plug assembly comprising;

a cable termination assembly attached to the and of a cable and an elastomeric seal fitted over the cable termination assembly, said cable termination assembly having a terminal which is electrically connected to a bared conductive core at an insulation stripped end of the cable and an insulator housing which receives the terminal and which is secured to an outer insulation jacket of the cable behind the terminal, and said elastomeric seal comprising an elastomeric sleeve which has a connector seal portion at one end which is fitted on the insulator housing, an attachment portion at the other end which has a bore which seals around the outer insulation jacket of the cable behind the housing, and means to retain the cable termination assembly with respect to the elastomeric sleeve in the longitudinal direction, the connector seal portion at one end of the elastomeric sleeve having a plurality of radial lip seals, and the elastomeric sleeve having a medial flange which has a longitudinal lip seal which projects toward the one end of the elastomeric sleeve which has the radial lip seals.

2. A sealed electrical connection comprising a socket connector and an electrical connector plug assembly as defined in claim 1 wherein:

the socket connector has a cavity which receives the one end of the elastomeric sleeve via an open end of the cavity at an end face of the socket connector, the cavity of the socket connector has a stepped peripheral wall which provides a plurality of circumferential sealing surfaces which progressively increase in diameter toward the open end of the cavity, the plurality of radial lips seals at the one end of the elastomeric sleeve progressively increase in diameter toward the medial flange of the elastomeric sleeve in a matched relationship to the circumferential sealing surfaces of the socket connector so that the radial lip seals sealingly engage the peripheral wall of the cavity at their respective cooperating sealing surfaces at the same time, and the medial flange of the elastomeric sleeve has a longitudinal seal lip which engages the end face of the socket connector.

3. A sealed electrical connection comprising a socket connector and an electrical connector plug assembly comprising;

a cable termination assembly attached to the end of a cable, an elastomeric seal fitted over the cable termination assembly to form a sub-assembly, and a holder which receives the sub-assembly for facilitating connection of the electrical plug assembly to a mating socket connector, said cable termination assembly having a terminal which is electrically connected to a bared conductive core at an insulation stripped end of the cable and an insulator housing which receives the terminal and which is secured to an outer insulation jacket of the cable behind the terminal, said elastomeric seal comprising an elastomeric sleeve which has a connector seal portion at one end which is fitted on the insulator housing, an attachment portion at the other end which has a bore which seals around the outer insulation jacket of the cable behind the housing, and means to retain the cable termination assembly with respect to the elastomeric sleeve in the longitudinal direction, and said holder having a retainer sleeve in which the sub-assembly comprising the cable termination assembly and elastomeric seal is disposed so that the connector seal portion of the elastomeric seal projects forwardly of the retainer sleeve, and the socket connector having a lock nib and a cavity with receives the one end of the elastomeric seal via an open end of the cavity at an end face of the socket connector, the holder having a deflectable latch arm which engages the lock nib to lock the electrical connector plug assembly to the socket connector, and the socket connector and the holder having cooperating means for guiding the electrical connector plug assembly into proper engagement with the socket connector.

4. The sealed electrical connection which is defined in claim 3 wherein:

the cooperating means for guiding the electrical connector plug assembly into proper engagement with the socket connector comprises cooperating longitudinal ribs and grooves, the longitudinal ribs being respectively part of a projecting upper shelf and a projecting lower lock member of the socket connector, and the longitudinal grooves being part of the holder.

5. The sealed electrical connection which is defined in claim 4 wherein:

the electrical connector plug assembly has a second sub-assembly comprising a second cable termination assembly and second elastomeric seal which is the same as the first sub-assembly, the holder has a second retainer sleeve which is along side the first retainer sleeve and which holds the second elastomeric seal in the same way, the socket connector has a second cavity which receives the connector seal portion of the second elastomeric seal in the same way, and the longitudinal grooves of the holder are at the juncture of the first and second retainer sleeves of the holder.

6. An electrical connector plug assembly comprising;

a cable termination assembly attached to the end of a cable, an elastomeric seal fitted over the cable termination assembly to form a sub-assembly, and a holder which receives the sub-assembly for facilitating connection of the electrical plug assembly to a mating socket connector, said cable termination assembly having a terminal which is electrically connected to a bared conductive core at an insulation stripped end of the cable and an insulator housing which receives the terminal and which is secured to an outer insulation jacket of the cable behind the terminal, the insulator housing of said cable terminal assembly having a medial flange, said elastomeric seal comprising an elastomeric sleeve which has a connector seal portion at one end which has a plurality of radial lip seals and which is fitted on the insulator housing, an attachment portion at the other end which has a bore which seals around the outer insulation jacket of the cable behind the housing, and a medial flange which has a longitudinal lip seal which projects toward the one end of the elastomeric sleeve which has the radial lip seals and which has a groove which receives the medial flange of the insulator housing to retain the cable termination assembly with respect to the elastomeric sleeve in the longitudinal direction, and said holder having a retainer sleeve for the sub-assembly comprising the cable termination assembly and elastomeric seal in which the attachment portion of the elastomeric seal is disposed so that the seal portion of the elastomeric seal projects forwardly of the retainer sleeve, the retainer sleeve having means to retain the elastomeric sleeve in the longitudinal direction with respect to the retainer sleeve.

7. A sealed electrical connection comprising a socket connector and an electrical connector plug assembly as defined in claim 6 wherein:

the socket connector has a lock nib and a cavity which receives the one end of the elastomeric sleeve via an open end of the cavity at an end face of the socket connector, the holder has a deflectable latch arm which engages the lock nib to lock the electrical connector plug assembly to the socket connector, and the socket connector and the holder have cooperating means for guiding the electrical connector plug assembly into proper engagement with the socket connector.

8. The electrical connection which is defined in claim 7 wherein:

the socket connector has a cavity which receives the one end of the elastomeric sleeve via an open end of the cavity at an end face of the socket connector, the cavity of the socket connector has a stepped peripheral wall which provides a plurality of circumferential sealing surfaces which progressively increase in diameter toward the open end of the cavity, the plurality of radial lips seals at the one end of the elastomeric seal progressively increase in diameter toward the medial flange of the elastomeric seal in a matched relationship to the circumferential sealing surfaces of the socket connector so that the radial lip seals sealingly engage the peripheral wall of the cavity at their respective cooperating sealing surfaces at the same time, and the medial flange of the elastomeric sleeve has longitudinal seal lip which engages an end face of the socket connector.

* * * * *